US005249407A

United States Patent [19]

Stuck

[11] Patent Number: 5,249,407

[45] Date of Patent: Oct. 5, 1993

[54] APPARATUS FOR PACKAGING POTTED PLANTS

[76] Inventor: Matthew A. Stuck, 1549 Brighton Beach Rd., Menasha, Wis. 54952

[21] Appl. No.: 949,897

[22] Filed: Sep. 23, 1992

[51] Int. Cl.[5] ..... B65B 67/00

[52] U.S. Cl. ..... 53/399; 53/260; 53/390; 53/529; 53/585; 53/592

[58] Field of Search ..... 53/176, 219, 241, 469, 53/397, 399, 390, 567, 528, 529, 585, 592, 260, 261, 459, 575

[56] References Cited

U.S. PATENT DOCUMENTS

| | | | |
|---|---|---|---|
| 1,183,454 | 5/1916 | Hayashi | 53/241 |
| 2,590,742 | 5/1952 | Williams | 53/241 |
| 2,989,828 | 7/1961 | Warp | 53/567 X |
| 3,271,922 | 9/1966 | Wallerstein et al. | 53/399 |
| 3,360,901 | 1/1968 | Gallo | 53/567 |
| 3,380,220 | 4/1968 | Jennings et al. | 53/469 X |
| 3,431,706 | 3/1969 | Stuck | 53/390 |
| 3,747,293 | 7/1973 | Van Slooten et al. | 53/390 X |
| 4,280,314 | 7/1981 | Stuck | 53/241 |
| 4,640,079 | 2/1987 | Stuck | 53/390 |

FOREIGN PATENT DOCUMENTS

| | | | |
|---|---|---|---|
| 2107006 | 9/1971 | Fed. Rep. of Germany | 53/390 |
| 587067 | 1/1959 | Italy | 53/390 |
| 1026259 | 4/1966 | United Kingdom | 53/390 |

*Primary Examiner*—John Sipos
*Assistant Examiner*—Daniel Moon
*Attorney, Agent, or Firm*—Andrus, Sceales, Starke & Sawall

[57] ABSTRACT

An apparatus for packaging potted plants. A plant support is mounted at the upper end of a vertical column and is adapted to support a potted plant having heavy foliage. One or more tapered paper sleeves are disposed around the support column beneath the plant support. A ring having a larger diameter than the pot is mounted for vertical movement on a second vertical column, and the ring carries an open-ended, flexible bag. The lower end of the bag includes an elastic cord, so that the lower end has a contracted diameter, which is smaller than the rim of the pot. The ring is initially positioned beneath the level of the plant support, the plant is then positioned on the support and the bag is drawn upwardly around the plant, folding the foliage inwardly, until the lower end of the bag is slightly above the rim of the pot. The sleeve is then drawn upwardly around the bag encompassing the foliage, and the bag is withdrawn from the sleeve.

18 Claims, 2 Drawing Sheets

APPARATUS FOR PACKAGING POTTED PLANTS

BACKGROUND OF THE INVENTION

Potted plants are normally packaged for shipment by growers or retailers in protective, tapered, paper sleeves. To facilitate the packaging of smaller potted plants in the sleeves, a packaging device, such as disclosed in U.S. Pat. No. 4,640,079, can be employed. In accordance with that patent, the potted plant is placed on a support that is mounted on the top of a vertical column. A group of nested paper sleeves are located around the column beneath the plant and the innermost sleeve is then drawn upwardly around the plant to bring the lower end of the sleeve into engagement with the pot to enclose the plant.

While the packaging device as disclosed in the aforementioned patent, has proven very successful with smaller plants, or plants with light foliage, it has not been adaptable for plants having heavy foliage, or foliage that drapes downwardly around the pot.

Because of this, it has been the practice by growers and retailers to manually insert the potted plants with heavy foliage into the paper sleeves. The manual process is normally carried out by two people, with one person holding the plant and the second holding the sleeve in an open condition. The sleeve is then moved upwardly around the plant. The manual packaging of plants is a tedious and time-consuming operation and frequently the heavy or draping foliage is trapped between the rim of the pot and the sleeve, causing the foliage to be broken or damaged.

Therefore, there has been a need for a simple and effective packaging device, which can be employed to package potted plants with heavy foliage.

SUMMARY OF THE INVENTION

The invention is directed to an apparatus for packaging potted plants and has particular application to the packaging of plants having heavy foliage, or plants having foliage the drapes downwardly over the pot.

The apparatus includes a base and a vertical column extends upwardly from the base and terminates in a generally flat plant support plate, which is adapted to support the potted plant. One or more open-ended, tapered paper sleeves are disposed around the vertical column and are located beneath the plant support.

A ring, having a diameter greater than the diameter of the rim of the pot, is aligned above the plant support, and is mounted for movement on a second vertical column that is parallel to the first column. The ring carries an open-ended, flexible, bag and the lower end of the bag has a smaller diameter than the upper end and contains an expandable elastic band.

To facilitate movement of the ring and bag on the second vertical column, a counterweight can be connected to the ring to counterbalance its weight and maintain the ring at any desired position along the length of the column. In addition, a frictional element can be interposed between the collar that carries the ring and the column to prevent free movement of the collar and ring relative to the column and retain the ring in a given position.

In operation, the bag is initially located at a lower position, in which the upper end of the bag and the ring are located slightly above the plant support. The potted plant is then positioned on the support and the ring is drawn upwardly around the pot and around the plant, folding the foliage inwardly. The smaller diameter lower end of the bag will expand as it moves upwardly around the pot, and the upward movement of the ring is terminated when the lower end of the bag is slightly above the rim of the pot. In this position, the foliage of the plant is fully contained within the bag.

The sleeve is then drawn upwardly around the bag until the lower end of the sleeve engages the pot, and the bag is then withdrawn upwardly from the sleeve to complete the operation. The foliage is thus fully contained within the protective sleeve.

As a feature of the invention, a second ring can be mounted on the second column and positioned around the first column. The sleeves are contained within the second ring and thus will be maintained in an open condition.

The apparatus of the invention greatly facilitates the packaging of potted plants having heavy foliage in the protective paper sleeve. The packaging can be done by a single operator.

As the foliage is drawn or folded upwardly as the bag is drawn around the pot, there is no possibility of the foliage being trapped between the rim of the pot and the protective sleeve. Thus, the apparatus provides an effective method of packaging plants with minimum damage to the plants.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
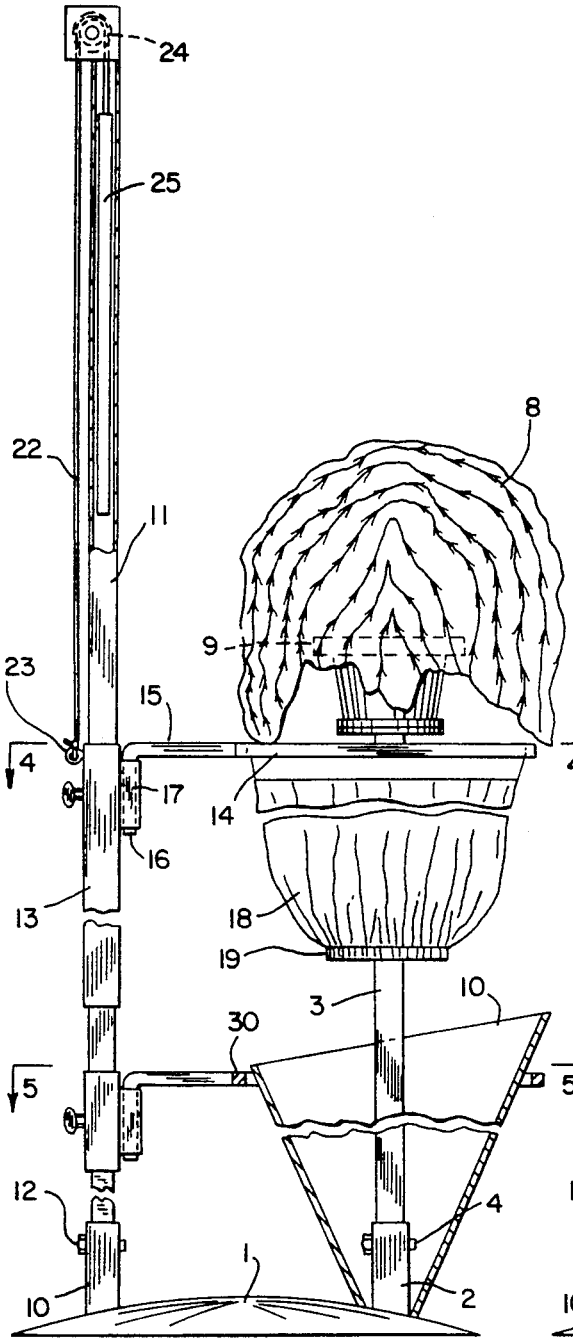
FIG. 1 is a side elevation of the apparatus of the invention with the bag being shown in a lower position.

The drawings illustrate an apparatus for packaging potted plants, and in particular to the packaging of potted plant having heavy or downwardly hanging foliage. The apparatus includes a base 1, which is to be mounted on a suitable foundation, and a tubular metal sleeve 2 extends upwardly from the base and receives the lower end of a vertical column 3. Bolt 4 extends through aligned openings in sleeve 2 and column 3 to maintain the column within the sleeve.

Mounted on the upper end of column 3 is a generally flat plant support 5 having an upper surface 6 of rubber or plastic material to support the pot 7 containing a plant 8. The upper rubber layer 6 provides a non-skid surface which will prevent the pot from sliding from the support 5.

Plant 8 is shown as having heavy, downwardly hanging foliage which drapes downwardly beyond the rim 9 of pot 7.

Located around column 3 is a group of nested, tapered, paper sleeves 10. The lower ends of sleeves 10 have a smaller diameter than the upper ends and are provided with a diameter, such that they will engage the outer tapered surface of the pot 7, as the sleeves are drawn upwardly around the pot during the packaging operation.

Extending upwardly from base 1 is a second metal sleeve 10*a*, which receives the lower end of a second vertical column 11 that is parallel to column 3. Bolt 12 extends through aligned openings in the sleeve 10*a* and column 11 to maintain the column in engagement with the sleeve.

Figure 4:
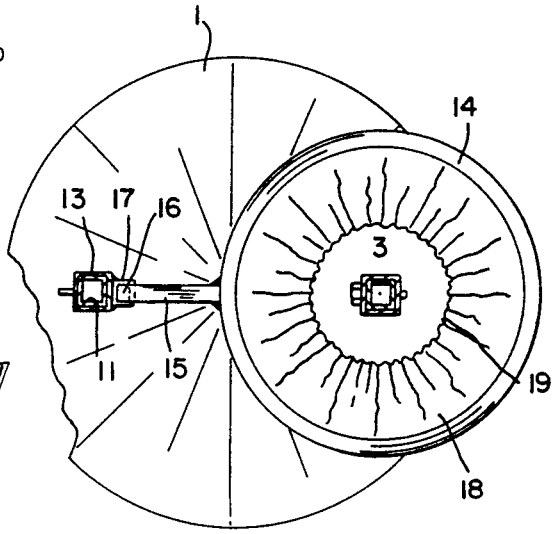
FIG. 4 is a view taken along line 4—4 in FIG. 1.

Columns 3 and 11 are preferably formed with a square cross section. A slide 13 of similar cross section is mounted for movement on column 11, and a ring 14 is removably connected to slide 13. As shown in FIG. 4, the axis of the ring is aligned with the plant support 5 and column 3.

To mount the ring 14 to the slide 13, a generally L-shaped arm 15 projects outwardly from the ring and the vertical section 16 of arm 15 is received within a socket 17 attached to slide 13. Both the section 16 and socket 17 have a non-circular cross section, such as a square cross section, to prevent rotation of the arm 15 relative to the slide 13 and maintain the ring in alignment with the plant support.

A flexible open-ended bag 18 is carried by ring 14. The upper edge of the bag 18 is secured to the ring, while an elastic cord or band 19, is secured to the lower end of the bag to provide the lower end of the bag with a smaller diameter than the upper end. The ring 14 and the upper end of bag 18 have a larger diameter than the rim 9 of pot 7, while the lower end of the bag, in its contracted state, has a smaller diameter than the rim 9 of pot 7.

To lock ring 14 at any given location on column 11, a threaded thumb screw 21 extends through an opening in slide 13 and is engaged with the column 11.

To counterbalance the weight of the ring 14 and slide 13, a counterbalancing system is employed. In this regard, one end of a cable 22 is attached to an eye 23 on the upper end of slide 13. The cable passes around a pulley 24 mounted on the upper end of column 11, and then downwardly within the interior of the column. The opposite end of the cable is attached to a counterweight which takes the form of an elongated rod 25. The counterweight acts to counterbalance the weight of the ring 14 and slide 13, so that the ring can be more easily lifted by the operator.

Figure 6:
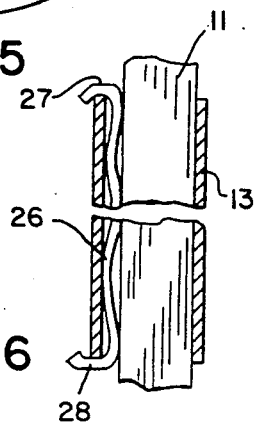
FIG. 6 is an enlarged fragmentary vertical section showing the frictional engagement of the slide to the column.

In order to hold the slide 13 and ring 14 at a given location on column 11, a frictional element or strip 26 is mounted within the slide and is engaged with the outer surface of column 11, as seen in FIG. 6. The upper and lower ends 27 and 28 of the strip 26 project outwardly of the respective ends of the slide and are bent outwardly to retain the strip within the slide. The strip 26 is provided with a series of undulations or bends which provide a biasing action to increase the frictional engagement of the slide 13 with the column 11

Figure 5:
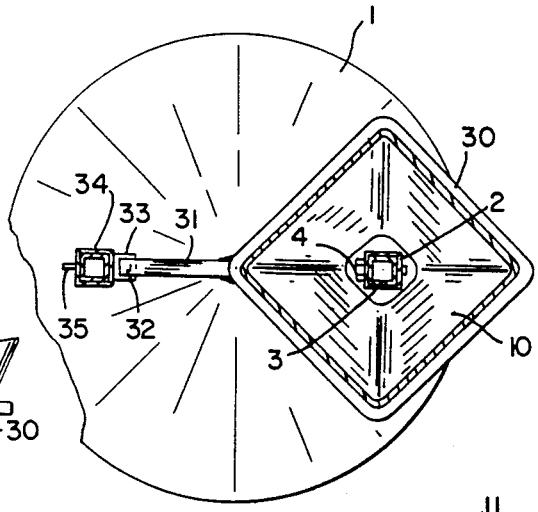
FIG. 5 is a horizontal section taken along line 5—5 of FIG. 1.

As a feature of the invention, the nest of sleeves 10, can be maintained in alignment beneath the plant support 5 by a second ring 30 which is mounted on column 11 and preferably has a rectangular shape, as shown in FIG. 5. An L-shaped arm 31 is connected to the ring and the vertical section 32 of the arm is received within a socket 33 attached to collar 34 that is secured to column 11 via a threaded thumb screw 35. The section 32, as well as the socket 33, have mating non-circular cross sections to prevent rotation of the arm 31 and ring 30 relative to the column 11

As shown in FIG. 1, the axis of ring 30 is aligned with column 3, thus maintaining the sleeves 10 in alignment with the plant support 5 and making it easier for an operator to grasp one of the sleeves and draw it upwardly.

FIG. 1 shows the initial stage of operation, with the nest of sleeves 10 disposed around the lower end of column 3 and the ring 14 positioned at a level slightly beneath the plant support 5. The lower end of the bag hangs downwardly to a position slightly above the upper end of the sleeves 10.

Figure 2:
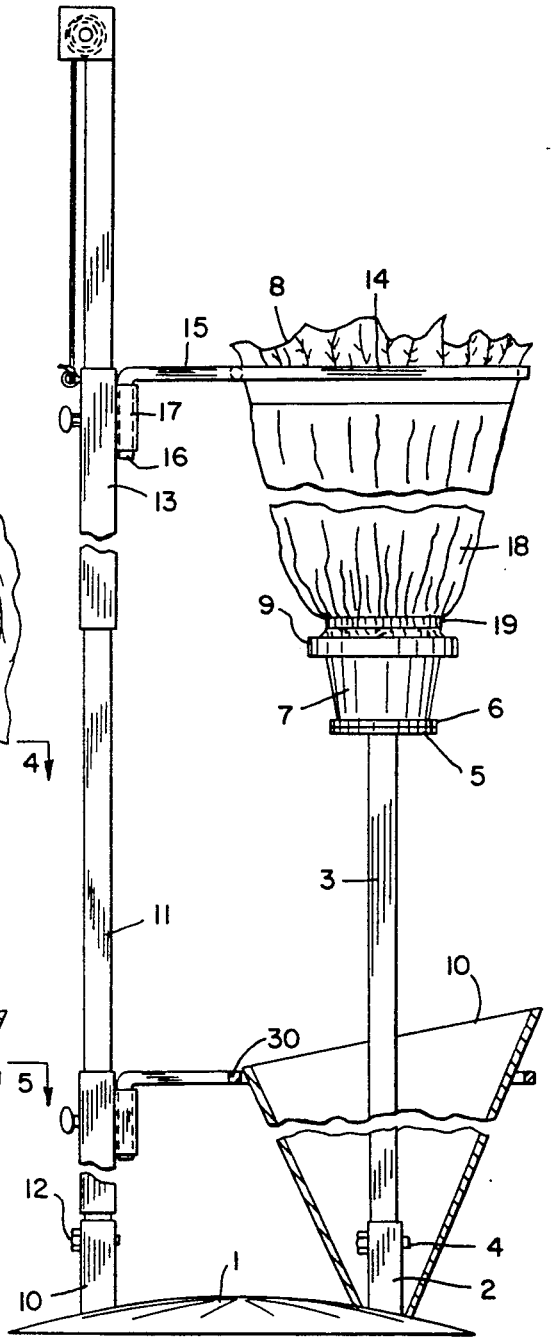
FIG. 2 is a view similar to FIG. 1 showing the bag in the upper position and containing the foliage on the plant.

The pot 7 containing plant 8 is then positioned on support 5 and the ring 14, along with the bag 18, is moved upwardly around the plant, causing the foliage to be folded upwardly and inwardly as the bag is moved upwardly. The lower end of bag 18 will engage the outer surface of pot 7 and due to the elastic cord 19 will expand outwardly as it moves upwardly over the pot. The upward movement of the ring 14 and bag 18 is terminated when the lower end of the bag is slightly above the upper rim 9 of the pot 7, as illustrated in FIG. 2. In this condition the foliage has been drawn upwardly and is contained within the bag 18.

Figure 3:
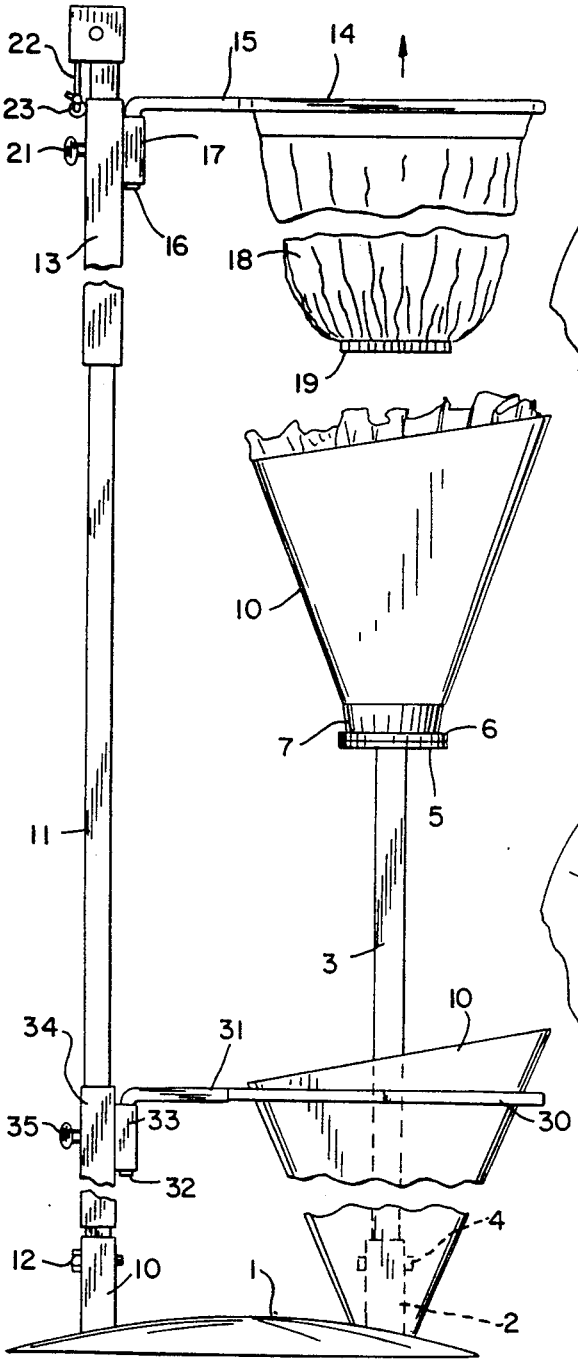
FIG. 3 is a view similar to FIG. 2 showing the paper sleeve drawn upwardly around the bag.

One of the nested sleeves 10 is then drawn upwardly around the pot 7 and around the bag 18, as shown in FIG. 3, until the lower end of the sleeve engages and is wedged against the outer surface of pit 7. In this condition, the bag 18 is fully contained within the outer sleeve, so that the bag can then be moved upwardly out of the sleeve, as shown in FIG. 3, resulting in the entire plant 8 being contained within the sleeve 10.

With the apparatus of the invention, the plant 8 can be packaged in the protective sleeve 10 without damage to the plant, for there is no possibility of the downwardly hanging foliage being trapped between the sleeve and the upper rim 9 of the pot 7.

As a further advantage, the plant can be packaged by a single operator, and in a much shorter period of time than that required for the manual packaging of plants, as done in the past.

Various modes of carrying out the invention are contemplated as being within the scope of the following claims particularly pointing out and distinctly claiming the subject matter which is regarded as the invention.

I claim:

1. A method of packaging plants, comprising the steps of disposing a tapered tubular protective sleeve around a vertical column, positioning an open-ended flexible tubular bag having an open upper end and an open lower end with a smaller cross sectional area than the upper end in general axial alignment with said column, with the upper end of the bag located adjacent the upper end of the column, mounting a pot containing a plant with foliage on the upper end of the column, moving the bag upwardly around the pot and around the plant the lower end of the bag radially expanding as the bag is moved upwardly around the pot and contracting to continue the foliage and terminating the upward movement of the bag when the lower end of the bag is adjacent an upper rim of the pot, drawing the sleeve upwardly around the bag until the lower end of the sleeve is disposed radially outward of said pot, and drawing the bag upwardly out of the sleeve to thereby confine the foliage within said sleeve.

2. The method of claim 1, and including the step of expanding the lower end of the bag as the bag is moved upwardly around the pot.

3. The method of claim 1, and including the step of mounting the upper end of the bag on a ring, and the step of moving the bag upwardly around the plant comprises moving the ring upwardly.

4. The method of claim 3, and including the step of counterbalancing the weight of the ring.

5. The method of claim 1, and including the step of moving the lower end of the sleeve into engagement with an outer surface of the pot as the sleeve is drawn upwardly around the pot.

6. An apparatus for packaging plants, comprising a first vertical column, a plant support disposed at an upper end of the first column to support a pot containing a plant having foliage, an open-ended tubular bag having an open upper end and an open lower end, the lower end of the bag having a smaller cross sectional area than the upper and radially contract around the plant to confine the foliage within the bag.

7. The apparatus of claim 6, and including a ring connected to the upper end of the bag, said apparatus also including a second vertical column and means for mounting the ring for vertical movement on said second column.

8. The apparatus of claim 7, wherein the lower end of the bag has a contracted condition and an expanded condition, the lower end of the bag in the contracted position having a smaller diameter than the upper peripheral rim of said pot.

9. The apparatus of claim 8, wherein said ring has a greater diameter than the peripheral rim of said pot.

10. The apparatus of claim 7, and including counterbalancing means operably connected to said ring for counterbalancing the weight of the ring and the bag.

11. The apparatus of claim 6, wherein said means for permitting radial expansion of the lower end of the bag comprises an elastic band secured to the lower end portion of said bag.

12. An apparatus for packaging plants, comprising a first vertical column, a plant support disposed at an upper end of said first column to support a pot containing a plant having foliage, an annular member mounted for vertical movement from a lower position adjacent said plant support to an upper position substantially above said plant support, a flexible open-ended tubular bag mounted on the annular member and having an open upper end and an open lower end, the lower end of the bag having a smaller cross sectional area than the upper end of the bag, the lower end of the bag being radially expandable and having a contracted condition and an expanded condition, means for holding a tapered protective sleeve disposed around the column and located beneath said plant support, means for moving said annular member initially being in said lower position upwardly around said plant causing the bag to fold the foliage inwardly the expandable lower end of the bag expanding to permit the bag to pass over the upper periphery of the pot and contracting around the plant to confine the foliage within the bag, said sleeve being drawn upwardly around the bag and the bag then being drawn upwardly out of the sleeve to thereby package the plant in the sleeve.

13. The apparatus of claim 12, and including a ring disposed around said column beneath the plant support and disposed to support a nested group of said protective sleeves.

14. The apparatus of claim 12, and including counterbalancing means operably connected to said annular member for counterbalancing the weight of said annular member.

15. The apparatus of claim 9, wherein said counterbalancing means comprises a counterweight mounted for movement, and a cable interconnecting said counterweight and said annular member.

16. The apparatus of claim 12, wherein said annular member is mounted for vertical movement on a second vertical column.

17. The apparatus of claim 16, and including a slide mounted for movement on said second column, means for removably connecting said annular member to said slide, and means for preventing horizontal movement of said annular member relative to said slide.

18. The apparatus of claim 17, and including frictional means interconnecting said slide and said second column to prevent free movement of said slide on said second column.

* * * * *

UNITED STATES PATENT AND TRADEMARK OFFICE

CERTIFICATE OF CORRECTION

PATENT NO. : 5,249,407

DATED : October 5, 1993

INVENTOR(S) : Matthew A. Stuck

It is certified that error appears in the above-indentified patent and that said Letters Patent is hereby corrected as shown below:

Col. 4, Line 60, CLAIM 1, After "plant" insert --,-- (comma);

Col. 4, Line 62, CLAIM 1, Delete "continue" and substitute therefore --confine--;

Col. 5, Line 20, CLAIM 6, After "upper" insert --end of the bag, the open ends of said bag being disposed generally in axial alignment with said column, means for holding a tapered protective sleeve disposed around the column and located beneath said plant support means for effecting vertical movement of the bag relative to the plant support to move the bag upwardly around the plant, and said bag including resilient means for radial expansion of the lower end of the bag as the bag is drawn upwardly around the pot to permit the pot--

Col. 5, Line 21, CLAIM 6, After "bag" and before "." (period insert --, said sleeve being drawn upwardly around the bag and the bag then being drawn upwardly out of the sleeve to thereby package the plant in the sleeve--

Signed and Sealed this

Fourth Day of October, 1994

*Attest:*

Bruce Lehman

BRUCE LEHMAN

*Attesting Officer*

*Commissioner of Patents and Trademarks*